US008434200B2

(12) United States Patent
Chen

(10) Patent No.: US 8,434,200 B2
(45) Date of Patent: May 7, 2013

(54) ADJUSTING DEVICE FOR TIGHTENING OR LOOSING LACES AND STRAPS

(76) Inventor: Chin-Chu Chen, Taichung (TW)

( * ) Notice: Subject to any disclaimer, the term of this patent is extended or adjusted under 35 U.S.C. 154(b) by 186 days.

(21) Appl. No.: 13/181,522

(22) Filed: Jul. 13, 2011

(65) Prior Publication Data

US 2013/0014359 A1 Jan. 17, 2013

(51) Int. Cl.

| | |
|---|---|
| ***A43C 11/00*** | (2006.01) |
| ***B65H 75/48*** | (2006.01) |
| ***A43C 7/00*** | (2006.01) |

(52) U.S. Cl.

USPC ..... 24/68 SK; 2/418; 2/712.9; 242/378.1; 242/388.1; 242/396.1; 36/50.5; 36/50.1; 36/58.5

(58) Field of Classification Search ..... None
See application file for complete search history.

(56) References Cited

U.S. PATENT DOCUMENTS

| | | | | |
|---|---|---|---|---|
| 5,934,599 | A * | 8/1999 | Hammerslag | 242/396.1 |
| 7,134,224 | B2 * | 11/2006 | Elkington et al. | 36/50.1 |
| 7,367,522 | B2 * | 5/2008 | Chen | 242/378.1 |
| 7,516,914 | B2 * | 4/2009 | Kovacevich et al. | 242/388.8 |
| 7,565,704 | B2 * | 7/2009 | Wu | 2/418 |
| 7,584,528 | B2 * | 9/2009 | Hu | 24/68 SK |
| 7,617,573 | B2 * | 11/2009 | Chen | 24/68 SK |
| 7,854,024 | B2 * | 12/2010 | Fang | 2/418 |
| 8,015,625 | B2 * | 9/2011 | Grim et al. | 2/420 |
| 8,032,993 | B2 * | 10/2011 | Musal | 24/68 B |
| 8,056,150 | B2 * | 11/2011 | Stokes et al. | 2/417 |
| 8,231,074 | B2 * | 7/2012 | Hu et al. | 242/388.1 |
| 8,235,321 | B2 * | 8/2012 | Chen | 242/378.1 |
| 8,245,371 | B2 * | 8/2012 | Chen | 24/712.9 |
| 8,308,098 | B2 * | 11/2012 | Chen | 242/378.1 |
| 8,353,087 | B2 * | 1/2013 | Chen | 24/68 SK |
| 8,359,672 | B2 * | 1/2013 | Moelker | 2/418 |
| 8,370,967 | B2 * | 2/2013 | Chen | 2/418 |
| 2004/0226190 | A1 * | 11/2004 | Elkington et al. | 36/50.5 |
| 2004/0232267 | A1 * | 11/2004 | Liao | 242/378.1 |
| 2005/0198866 | A1 * | 9/2005 | Wiper et al. | 36/50.1 |
| 2005/0247813 | A1 * | 11/2005 | Kovacevich et al. | 242/388.6 |
| 2008/0066345 | A1 * | 3/2008 | Hammerslag et al. | 36/50.1 |
| 2008/0066346 | A1 * | 3/2008 | Hammerslag et al. | 36/50.1 |
| 2008/0083135 | A1 * | 4/2008 | Hammerslag et al. | 36/50.5 |
| 2008/0295229 | A1 * | 12/2008 | Fang | 2/418 |
| 2009/0184189 | A1 * | 7/2009 | Soderberg et al. | 242/395 |
| 2010/0095438 | A1 * | 4/2010 | Moelker | 2/418 |
| 2011/0088148 | A1 * | 4/2011 | Chen | 2/418 |
| 2011/0112448 | A1 * | 5/2011 | Wu | 601/85 |
| 2011/0191946 | A1 * | 8/2011 | Fang | 2/418 |
| 2011/0266384 | A1 * | 11/2011 | Goodman et al. | 242/396.4 |
| 2012/0228419 | A1 * | 9/2012 | Chen | 242/395 |
| 2013/0025100 | A1 * | 1/2013 | Ha | 24/712.9 |

* cited by examiner

*Primary Examiner* — Jack W. Lavinder

(57) ABSTRACT

An adjusting device for tightening or loosing laces and straps includes a base, an actuating member and a knob. When a user rotates the knob clockwise, the adjusting device is tightening a flexible strap of the clothing or a lace of the footwear. However, when a user rotates the knob counterclockwise, the adjusting device is loosing a flexible strap of the clothing or a lace of the footwear. The knob never moves up and down along the axis during the operation for tightening or loosing the flexible strap or the lace.

7 Claims, 9 Drawing Sheets

ADJUSTING DEVICE FOR TIGHTENING OR LOOSING LACES AND STRAPS

BACKGROUND OF THE INVENTION

1. Field of the Invention

The present invention relates to a tightening device applied in footwear or clothing, and more particularly to an adjusting device for tightening or loosing laces and straps.

2. Description of Related Art

Referring to U.S. Pat. No. 6,289,558, a conventional tightening device for laces includes a knob, a plurality of gear wheels with ratchet sections, a reel and a releasable lock mechanism. The reel is rotatable for receiving the lace. The knob is connected to the gear wheels and the knob is moveable along an axis of rotation between an engaged position and a disengaged position relative to the releasable lock mechanism. The gear wheel drives the reel to wind or unwind the lace. When a user rotates the knob in the said first direction, the reel is also driven by the gear wheels to rotate in the first direction for winding the lace. In addition, the releasable lock mechanism prevents rotation of the reel in the said second direction for unwinding the lace when the knob is located at the engaged position relative to the releasable lock mechanism. In contrast, when the knob is moved to a disengaged position relative to the releasable lock mechanism along the axis of rotation, the reel is free to rotate in the second direction for unwinding the lace. Another conventional tightening device for helmet straps also includes a knob, a plurality of gear wheels with ratchet sections, two straps with teeth and a releasable lock mechanism. The only difference is that the gear wheels pull the two straps back and forth through the ratchet sections engaged the teeth of two straps. There is no reel in the tightening device for helmet straps.

The disadvantage of the conventional tightening device is as following:

1. The user needs to move the knob to one engaged position or one disengaged position at first, then the user can rotate the knob to wind or unwind the lace and the strap. Therefore, the user cannot directly rotate the knob to wind and unwind the lace and the strap.

2. The releasable lock mechanism might be broken easily after the knob is moving up and down frequently, and the knob might unexpectedly depart from the tightening device.

The present invention has arisen to mitigate and/or obviate the disadvantages of the conventional.

SUMMARY OF THE INVENTION

The main objective of the present invention is to provide an improved tightening device applied in footwear or clothing.

To achieve the objective, a comprises a base having an axis at the center, the base having a receiving space defined therein for receiving a flexible strap or a lace, a through hole opened on the base and communicated with the receiving space, a plurality of unidirectional inclined planes deposited circularly around the through hole on the base, an actuating member having a gear wheel, the gear wheel having a connecting hole at the center, the gear wheel passed through the through hole and driving the flexible strap or the lace to move back and forth in the receiving space, an opening opened on the actuating member opposite to the connecting hole, the opening communicating with the connecting hole thereby the axis of the base passes through the connecting hole and the opening for firmly connecting to the center of a knob, the actuating member having a plurality of driving ribs thereon, an assembling space being formed from one driving rib to another driving rib for connecting to the knob, the actuating member having a plurality of flexible arms, each of the flexible arms having a second inclined surface, each of the flexible arms having an inclined tooth corresponding to the unidirectional inclined planes, the inclined tooth having an inclined portion and a vertical portion, the inclined portions of the unidirectional inclined planes facing to the inclined portions of the inclined teeth, thereby when the actuating member is rotated clockwise relative to the base, the inclined teeth move up along the inclined portions of the unidirectional inclined planes such that the inclined teeth jump up and down along the unidirectional inclined plane clockwise; but when the actuating member is rotated counterclockwise relative to the base, the vertical portions of the inclined teeth resist against the vertical portions of the unidirectional inclined planes such that the actuating member cannot be directly rotated counterclockwise relative to the base, the knob covering the actuating member and being rotatable relative to the base, the knob having an anti-slipping texture formed on the lateral side of the knob, at least one assembling rib deposited on an inner surface of the knob, the assembling rib corresponding to the assembling space of the actuating member for driving the actuating member to rotate, a preserving space being defined between the assembling rib and the assembling space, wherein the assembling rib cannot touch the driving rib in the preserving space when the knob is rotated counterclockwise slightly, thereby the actuating member is not rotated counterclockwise by the knob, a plurality of adjusting ribs deposited on the inner surface of the knob and corresponding to the flexible arms, each of the adjusting ribs having a first inclined surface facing to the flexible arm, the first inclined surface facing to the second inclined surface for adapting to lift up the flexible arms smoothly along the adjusting ribs, wherein each of the flexible arms is lifted up along the first inclined surface by the adjusting rib when the knob is kept rotating counterclockwise and the assembling rib keeps moving toward the driving rib in the preserving space, thereby each of the inclined teeth is disengaged with the unidirectional inclined planes, the flexible strap further comprising a first strap and a second strap, the first strap having a lower teeth portion, the second strap having an upper teeth portion, the gear wheel engaging with the upper teeth portion and the lower teeth portion, a reel placed into the base for connecting to the gear wheel of the actuating member, the reel having a lace groove for winding or unwinding the lace, an engaging hole opened at the center of the reel for engaging with the gear wheel of the actuating member;

wherein when the knob is rotated clockwise to drive the actuating member, the inclined teeth move up along the inclined portions of the unidirectional inclined planes such that the inclined teeth jump up and down along the unidirectional inclined plane clockwise and the actuating member is rotated clockwise relative to the base, consequently the gear wheel is rotated clockwise for tightening the flexible strap or the lace; when the knob stops rotating clockwise, the actuating member is stopped rotating because the vertical portions of the inclined teeth resist against the vertical portions of the unidirectional inclined planes, consequently the flexible strap or the lace is neither tightened nor loosed; when the knob is rotated counterclockwise to drive the actuating member, each of the flexible arms is lifted up along the first inclined surface by the adjusting rib and the assembling rib keeps moving toward the driving rib in the preserving space simultaneously; after each of the inclined teeth is disengaged with the unidirectional inclined planes completely, the actuating member can be rotated counterclockwise relative to the base, consequently the gear wheel is rotated counterclockwise for loosing the flexible strap or the lace; the knob never moves up and down along the axis during the operation for tightening or loosing the flexible strap or the lace.

Further benefits and advantages of the present invention will become apparent after a careful reading of the detailed description with appropriate reference to the accompanying drawings.

DETAILED DESCRIPTION OF THE INVENTION

Figure 1:
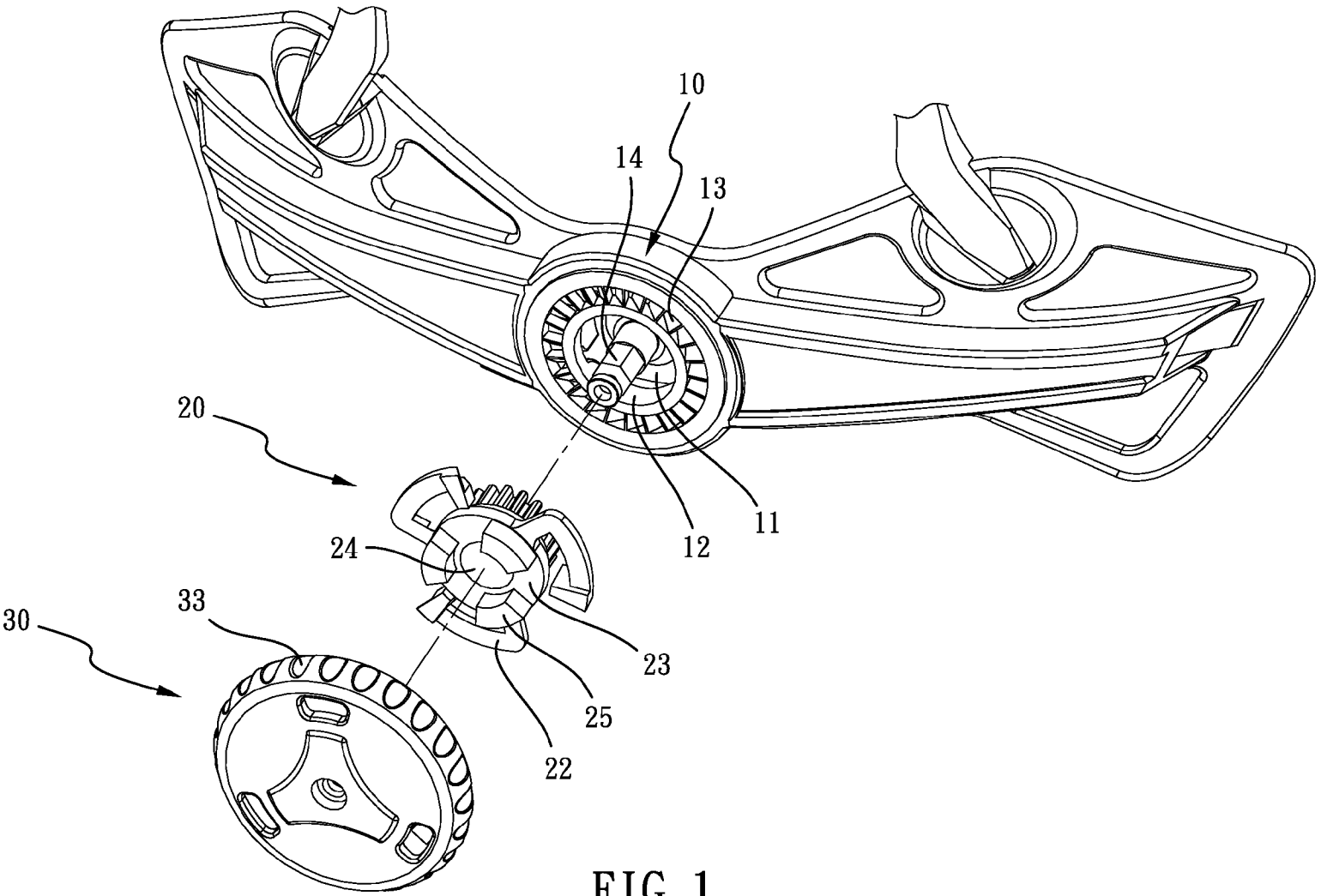
FIG. 1 is an exploded view of an adjusting device for tightening or loosing laces and straps of the present invention.
Figure 2:
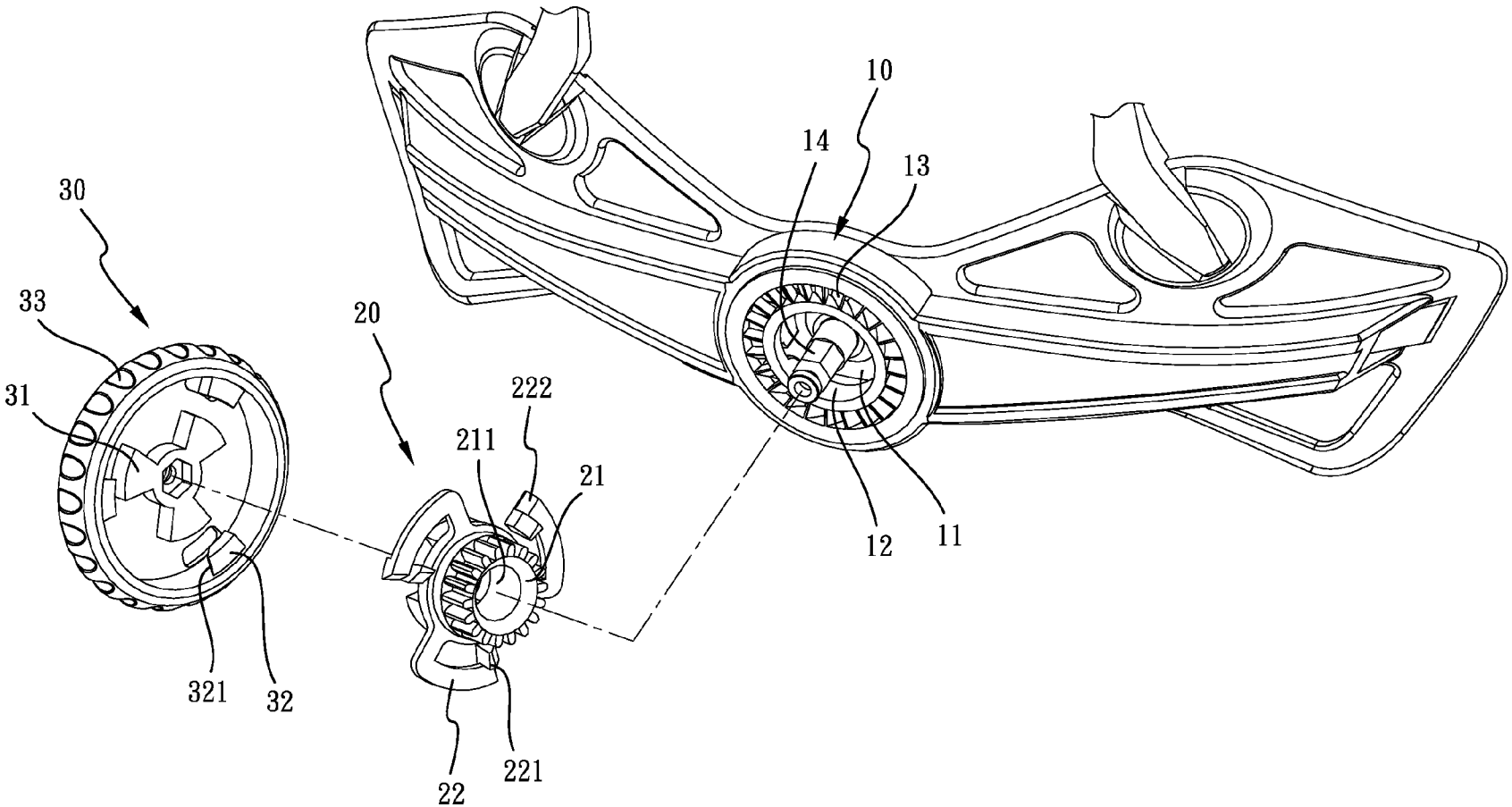
FIG. 2 is an exploded view of the adjusting device for tightening or loosing laces and straps of the present invention from another viewpoint.
Figure 3:
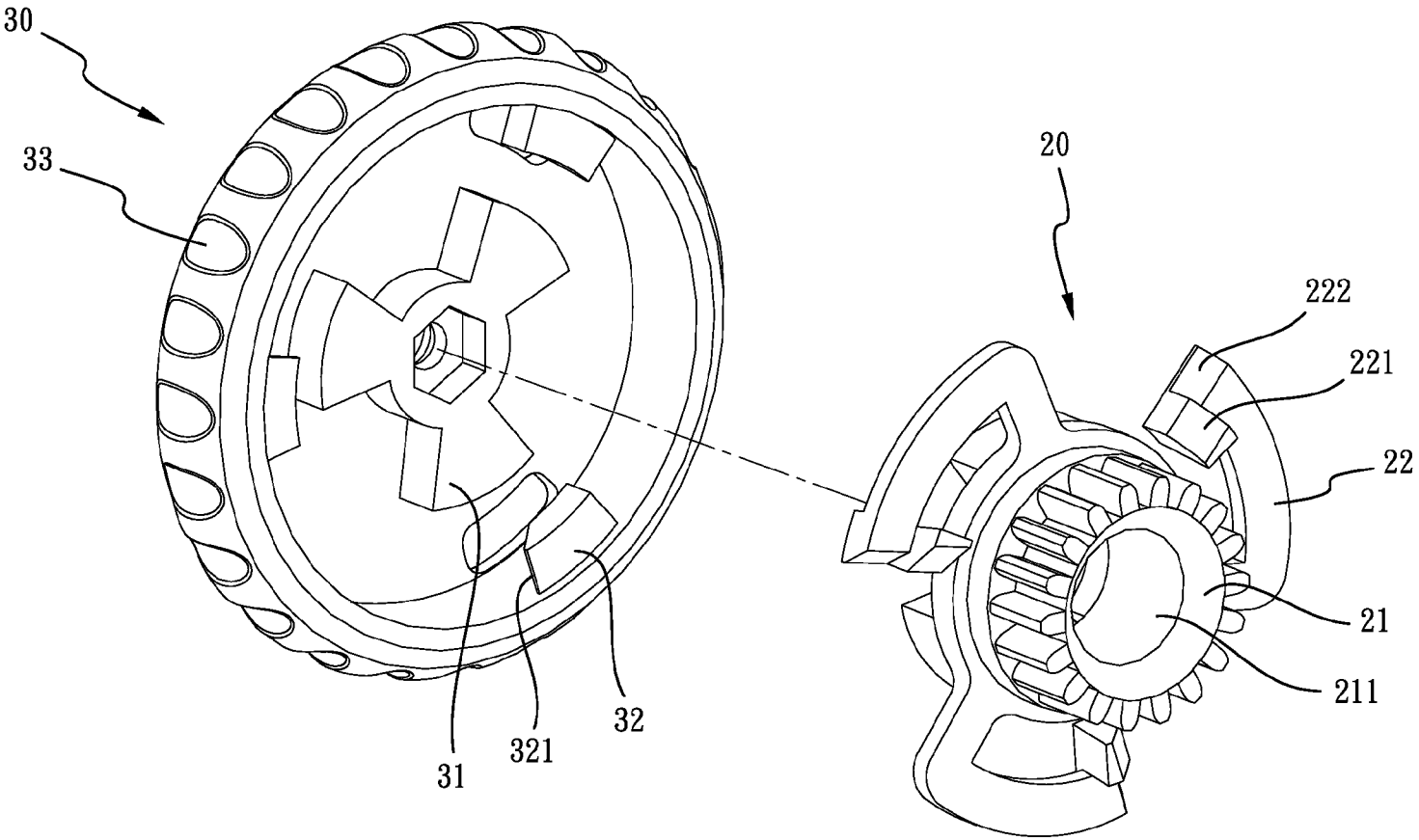
FIG. 3 is an exploded view of a knob and an actuating member.
Figure 4:
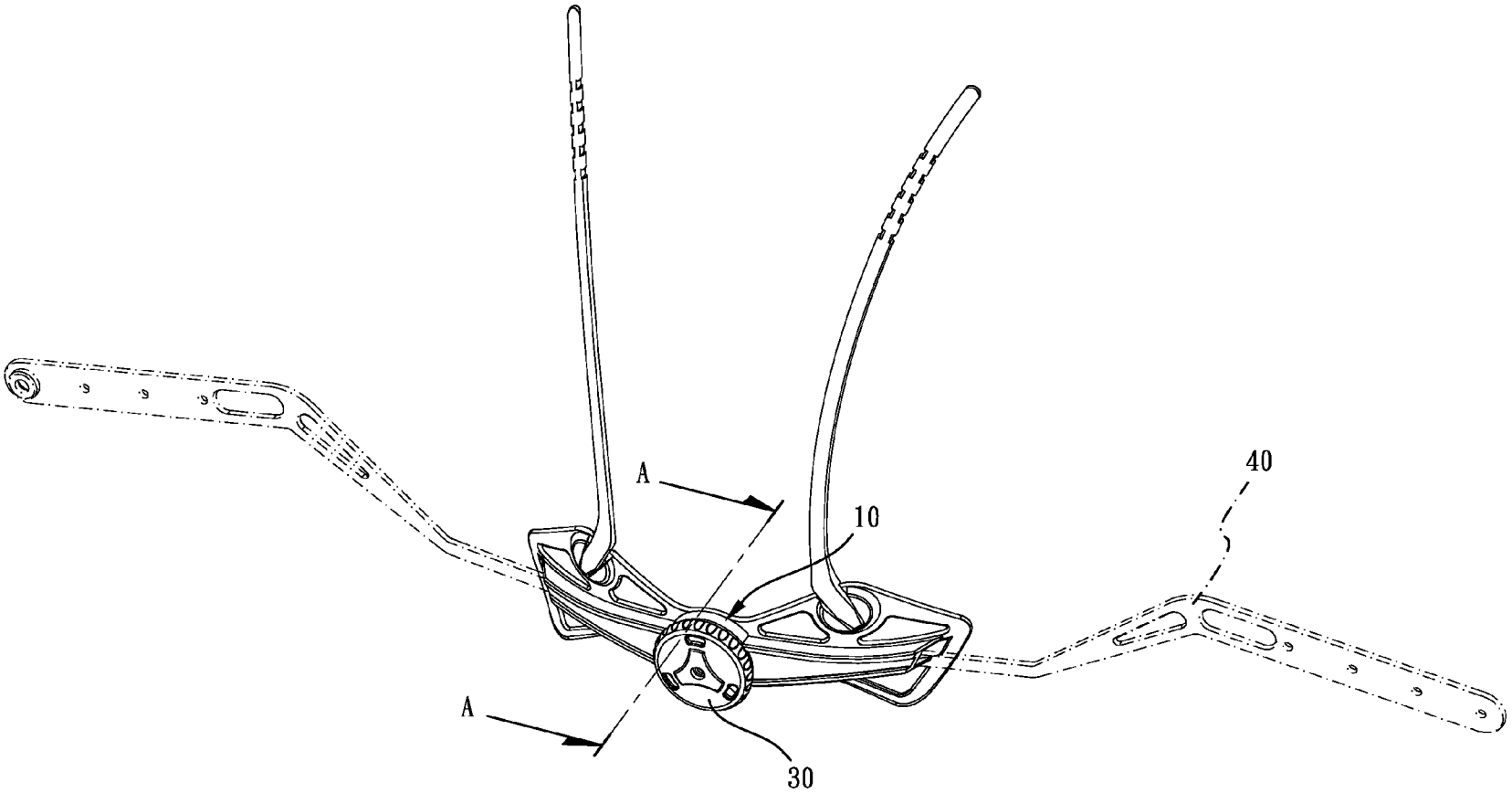
FIG. 4 is an assembled view of the adjusting device for tightening or loosing laces and straps with a flexible strap of helmets.

Referring to the drawings to FIGS. 1-9, an adjusting device for tightening or loosing laces and straps in accordance with the present invention comprises a base 10, an actuating member 20 and a knob 30. An axis 14 is deposited at the center of the base 10. The base 10 has a receiving space 11 defined therein for receiving a flexible strap 40. A through hole 12 is opened on the base 10 and is communicated with the receiving space 11. A plurality of unidirectional inclined planes 13 is deposited circularly around the through hole 12 on the base 10.

The actuating member 20 has a gear wheel 21. The gear wheel 21 has a connecting hole 211 at the center. The gear wheel 21 is passed through the through hole 12 and drives the flexible strap 40 to move back and forth in the receiving space 11. The actuating member 20 has a plurality of driving ribs 25 thereon. An assembling space 23 is formed from one driving rib 25 to another driving rib 25 for connecting to the knob 30. An opening 24 is opened on the actuating member 20 opposite to the connecting hole 211. The opening 24 is communicating with the connecting hole 211 thereby the axis 14 of the base 10 passes through the connecting hole 211 and the opening 24 for firmly connecting to the center of the knob 30. The actuating member 20 has a plurality of flexible arms 22. Each of the flexible arms 22 has a second inclined surface 222. Each of the flexible arms 22 has an inclined tooth 221 corresponding to the unidirectional inclined planes 13. The inclined tooth 221 has an inclined portion and a vertical portion. The inclined portions of the unidirectional inclined planes 13 are facing to the inclined portions of the inclined teeth 221. Therefore, when the actuating member 20 is rotated clockwise relative to the base 10, the inclined teeth 221 move up along the inclined portions of the unidirectional inclined planes 13 so that the inclined teeth 221 jump up and down along the unidirectional inclined plane 13 clockwise. However, when a user tries to rotate the actuating member 20 counterclockwise relative to the base 10, the vertical portions of the inclined teeth 221 resist against the vertical portions of the unidirectional inclined planes 13 so that the actuating member 20 cannot be directly rotated counterclockwise relative to the base 10.

The knob 30 is covering the actuating member 20 and is rotatable relative to the base 10. At least one assembling rib 31 is deposited on an inner surface of the knob 30. The assembling rib 31 is corresponding to the assembling space 23 of the actuating member 20 for driving the actuating member 20. The assembling ribs 31 push the driving ribs 25 for driving the rotation of the actuating member 20. A preserving space is defined between the assembling rib 31 and the assembling space 23 when the knob 30 is covering the actuating member 20, wherein the assembling rib 31 cannot touch the driving rib 25 in the preserving space when the knob 30 is rotated counterclockwise slightly, thereby the actuating member 20 is not driven counterclockwise by the knob 30 when the knob 30 is rotated counterclockwise slightly. A plurality of adjusting ribs 32 is deposited on the inner surface of the knob 30 and is corresponding to the flexible arms 22. Each of the adjusting ribs 32 has a first inclined surface 321 facing to the second inclined surface 222 of the flexible arm 22, wherein each of the flexible arms 22 is lifted up along the first inclined surface 321 by the adjusting rib 32 when the knob 30 is kept rotating counterclockwise and the assembling rib 31 keeps moving toward the driving rib 25 in the preserving space, thereby each of the inclined teeth 221 is disengaged with the unidirectional inclined planes 13. The first inclined surface 321 facing to the second inclined surface 222 is adapted to lift up the flexible arms 22 smoothly along the adjusting ribs 32.

Furthermore, the knob 30 has an anti-slipping texture 33 formed on the lateral side of the knob 30, thereby the user can easily rotate the knob 30 through the anti-slipping texture 33.

Figure 9:
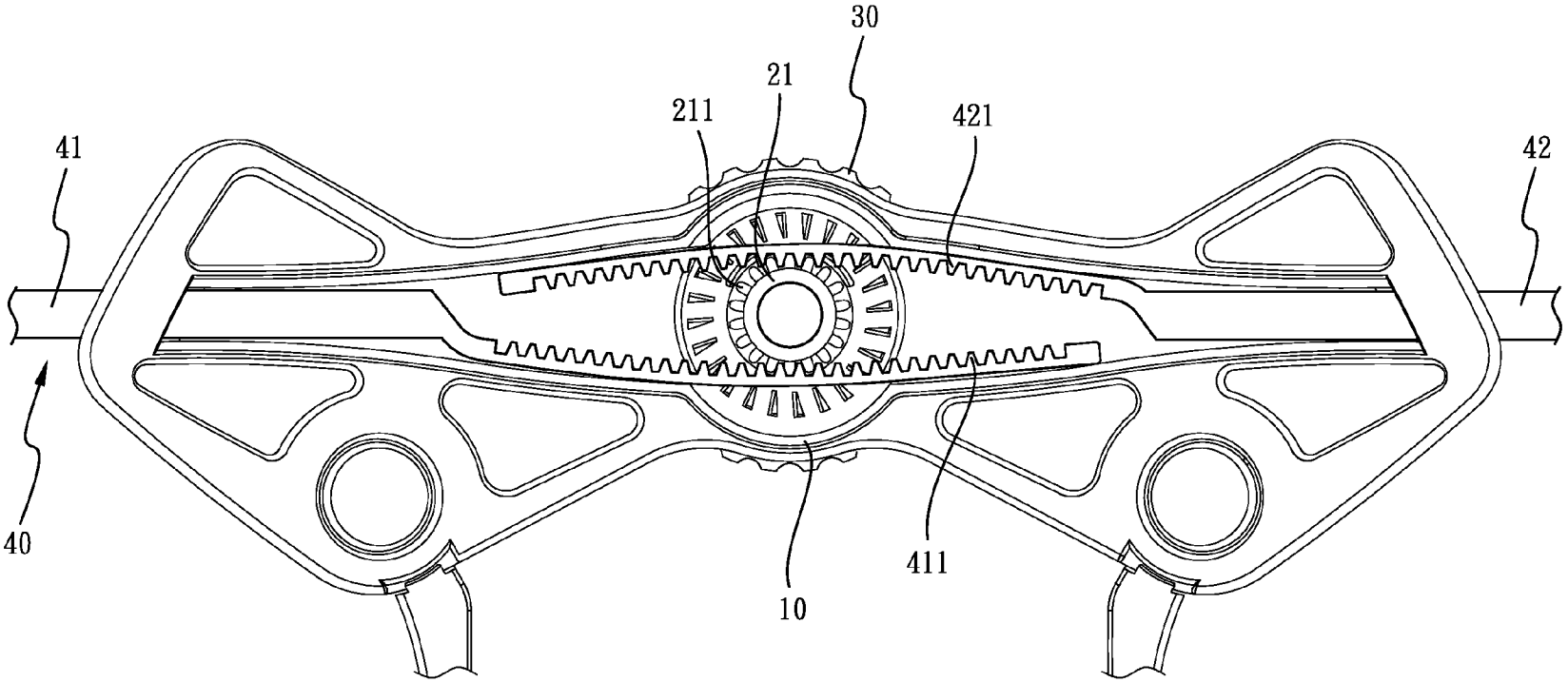
FIG. 9 is an assembled view of the adjusting device for tightening or loosing laces and straps setting with the flexible strap of helmets from rear viewpoint.

The flexible strap 40 further comprises a first strap 41 and a second strap 42. The first strap 41 has a lower teeth portion 411. The second strap 42 has an upper teeth portion 421. The gear wheel 21 engages with the upper teeth portion 421 and the lower teeth portion 411 (as shown in FIG. 9). When the actuating member 20 is rotated, the upper teeth portion 421 and the lower teeth portion 411 are moved toward each other or awayfrom each other by the driving of the gear wheel 21. Therefore, the first strap 41 and the second strap 42 are moving toward for tightening the flexible strap 40, and moving away for loosing the flexible strap 40.

Figure 6:
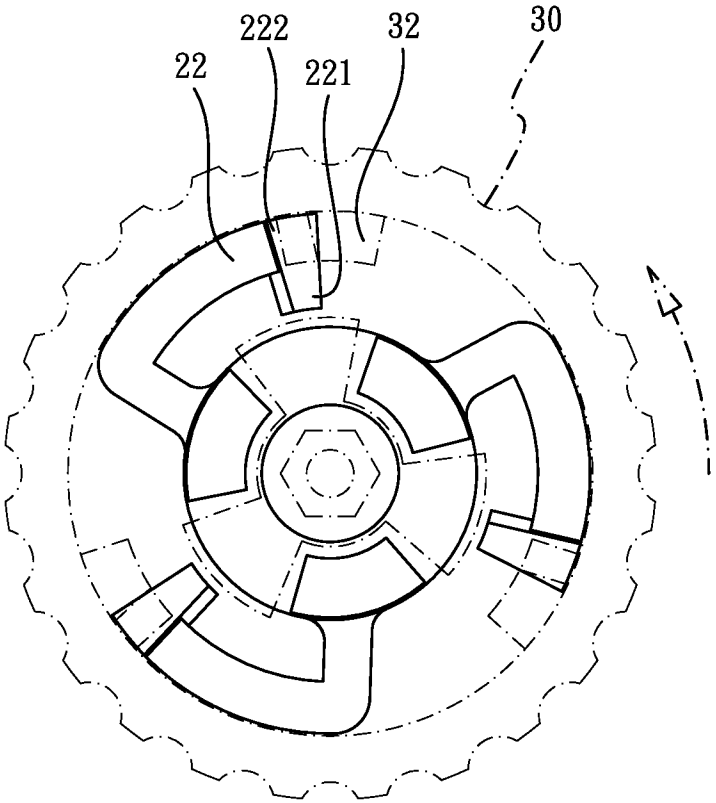
FIG. 6 is a front view of the actuating member within the knob for showing the knob driving the actuating member to rotate counterclockwise.
Figure 5:
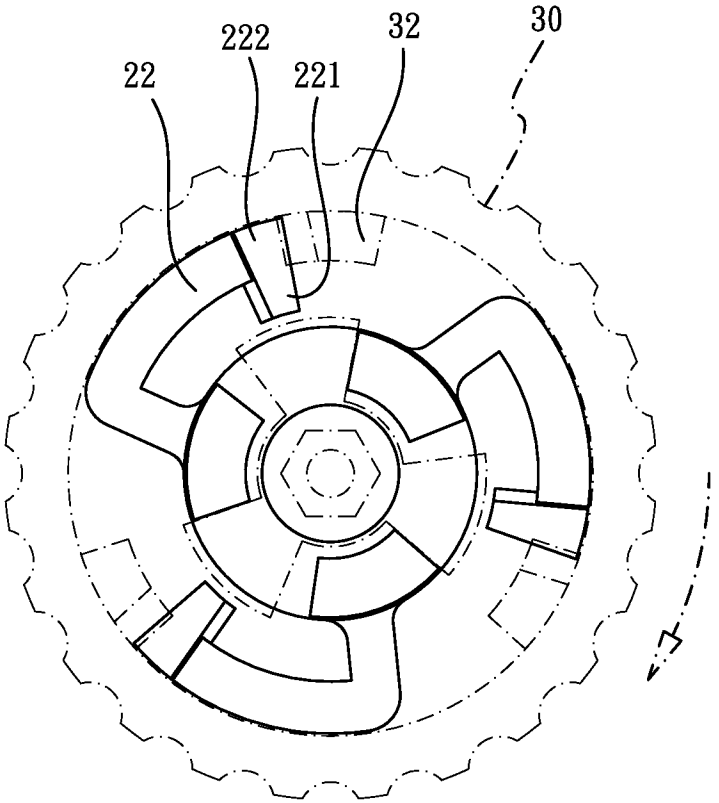
FIG. 5 is a front view of the actuating member within the knob for showing the knob driving the actuating member to rotate clockwise.
Figure 8:
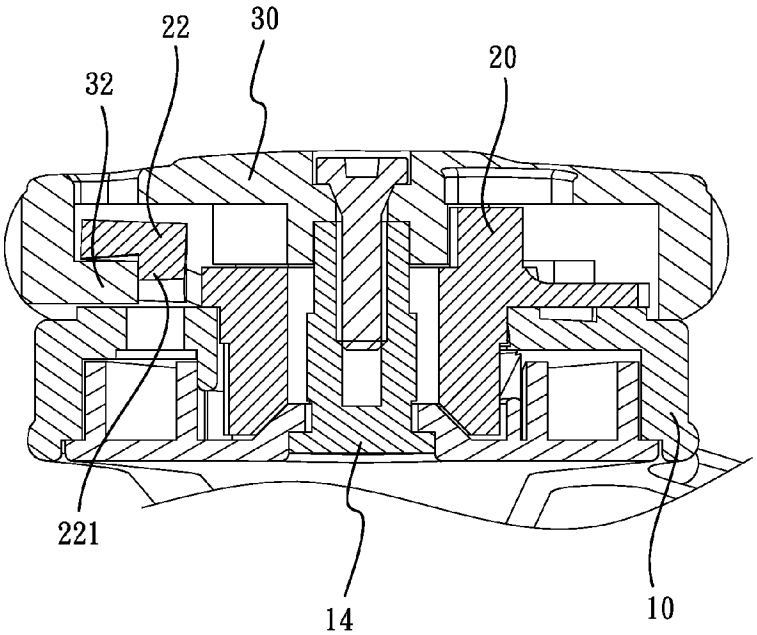
FIG. 8 is a cross-sectional view of the adjusting device for tightening or loosing laces and straps along a line AA shown in FIG. 4 for showing the knob driving the actuating member to rotate counterclockwise.
Figure 7:
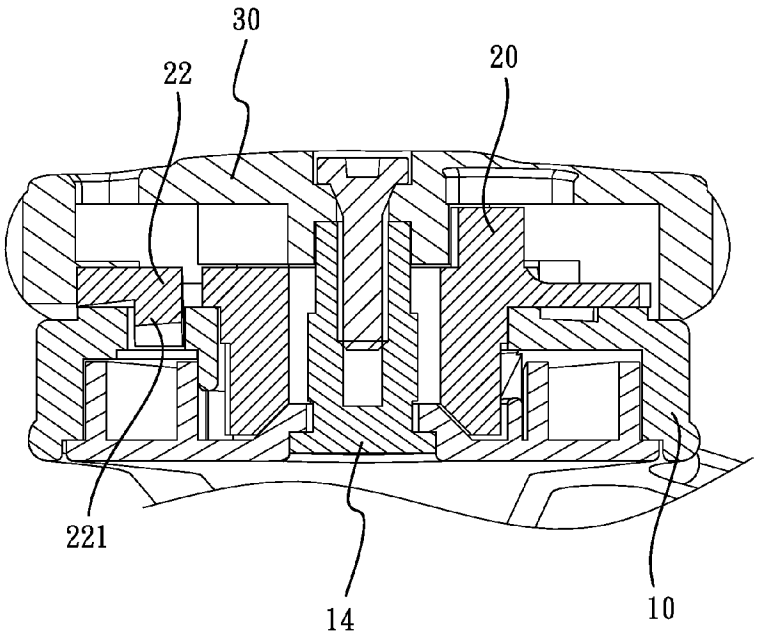
FIG. 7 is a cross-sectional view of the adjusting device for tightening or loosing laces and straps along a line AA shown in FIG. 4 for showing the knob driving the actuating member to rotate clockwise.

When the knob 30 is rotated clockwise to drive the actuating member 20, the inclined teeth 221 move up along the inclined portions of the unidirectional inclined planes 13 so that the inclined teeth 221 jump up and down along the unidirectional inclined plane 13 clockwise and the actuating member 20 is rotated clockwise relative to the base 10. Consequently, the gear wheel 21 is rotated clockwise to keep the first strap 41 and the second strap 42 moving toward for tightening the flexible strap 40. When the knob 30 stops rotating clockwise, the actuating member 20 is stopped rotating because the vertical portions of the inclined teeth 221 resist against the vertical portions of the unidirectional inclined planes 13. Consequently, the first strap 41 and the second strap 42 are not moved back for loosing the flexible strap 40 or moved forth for tightening the flexible strap 40 (as shown in FIGS. 5 and 7). When the knob 30 is rotated counterclockwise to drive the actuating member 20, each of the flexible arms 22 is lifted up along the first inclined surface 321 by the adjusting rib 32 and the assembling rib 31 keeps moving toward the driving rib 25 in the preserving space simultaneously. After each of the inclined teeth 221 is disengaged with the unidirectional inclined planes 13 completely, the actuating member 20 can be rotated counterclockwise relative to the base 10. Consequently, the gear wheel 21 is rotated counterclockwise to keep the first strap 41 and the second strap 42 moving away for loosing the flexible strap 40 (as shown in FIGS. 6 and 8). Moreover, the knob 30 never moves up and down along the axis 14 during the operation for tightening or loosing the flexible strap 40 as shown in FIGS. 7 and 8.

Figure 10:
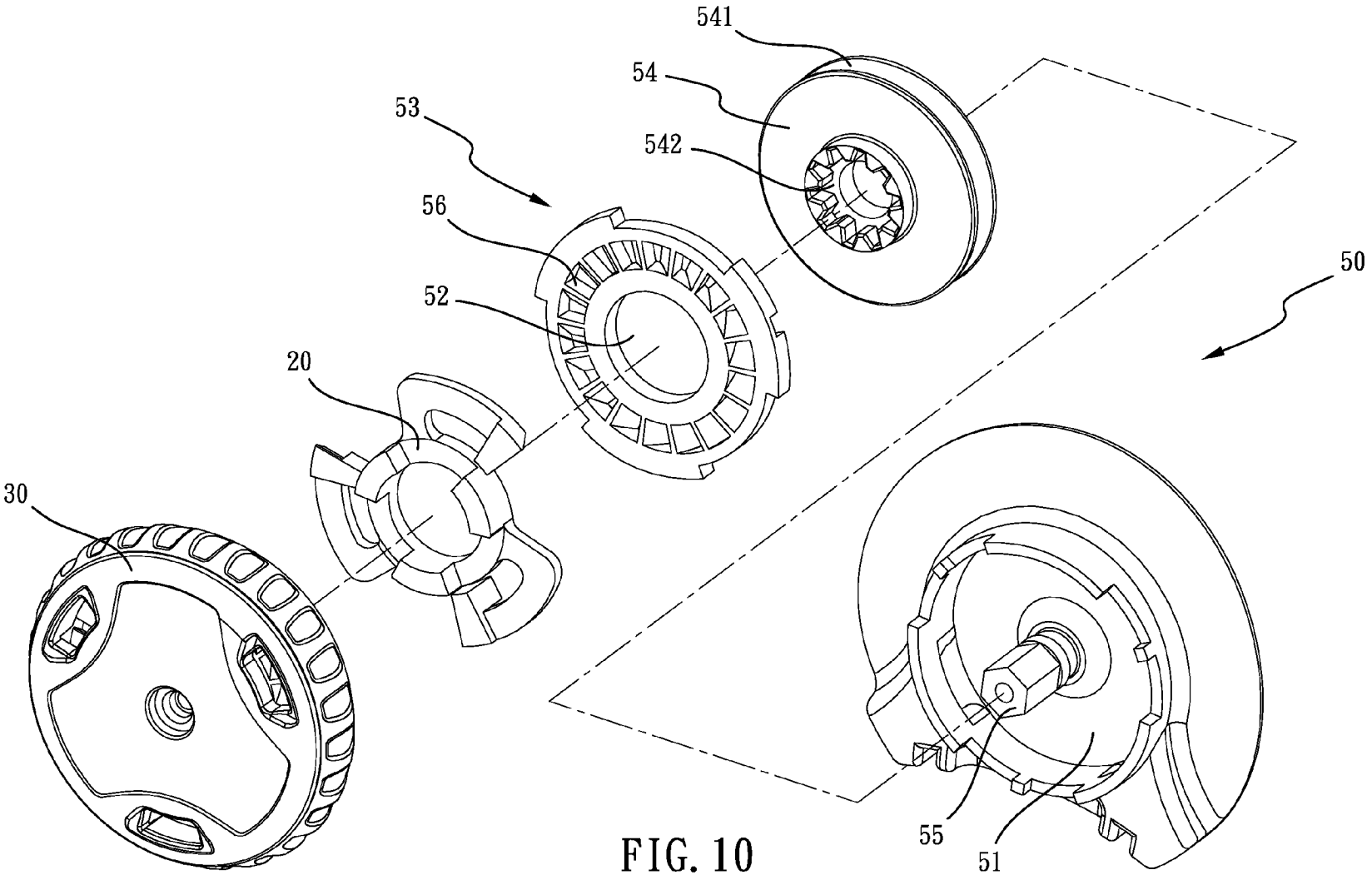
FIG. 10 is an exploded view of the second embodiment of the adjusting device for tightening or loosing laces and straps of the present invention.
Figure 11:
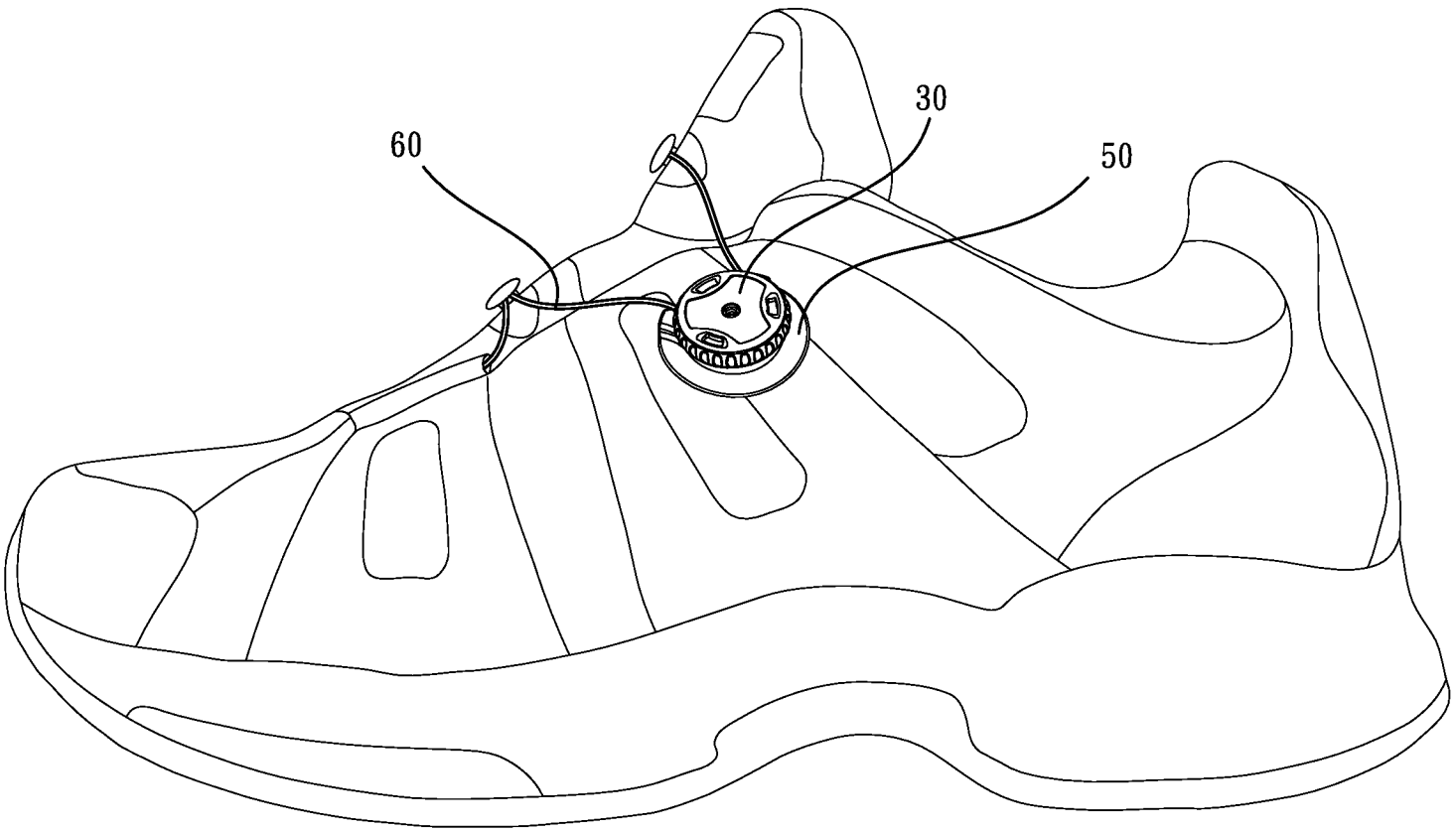
FIG. 11 is an assembled view of the adjusting device for tightening or loosing laces and straps being set up on footwear.

Referring to the drawings to FIGS. 10 and 11, a second embodiment of the adjusting device for tightening or loosing laces and straps has another base 50. An axis 55 is deposited at the center of the base 50. The base 50 has a receiving space 51 defined therein for receiving a lace 60. The base has a functional base 53. A through hole 52 is opened on the functional base 53. A plurality of unidirectional inclined planes 56 is deposited circularly around the through hole 52 on the functional base 53. A reel 54 is placed into the base 50 for connecting to the gear wheel 21 of the actuating member 20. The reel 54 has a lace groove 541 for winding or unwinding the lace 60. An engaging hole 542 is opened at the center of the reel 54 for engaging with the gear wheel 21 of the actuating member 20, thereby the reel 54 is rotated by the actuating member 20 for tightening or loosing the lace 40 as shown in FIG. 11.

Although the invention has been explained in relation to its preferred embodiment, it is to be understood that many other possible modifications and variations can be made without departing from the spirit and scope of the invention as hereinafter claimed.

What is claimed is:

1. An adjusting device for tightening or loosing laces and straps comprising:

a base having an axis at the center, the base having a receiving space defined therein for receiving a flexible strap or a lace, a through hole opened on the base and communicated with the receiving space, a plurality of unidirectional inclined planes deposited circularly around the through hole on the base;

an actuating member having a gear wheel, the gear wheel passed through the through hole and driving the flexible strap or the lace to move back and forth in the receiving space, the actuating member having a plurality of driving ribs thereon, an assembling space being formed from one driving rib to another driving rib for connecting to a knob, the actuating member having a plurality of flexible arms, each of the flexible arms having an inclined tooth corresponding to the unidirectional inclined planes, the inclined tooth having an inclined portion and a vertical portion, the inclined portions of the unidirectional inclined planes facing to the inclined portions of the inclined teeth, thereby when the actuating member is rotated clockwise relative to the base, the inclined teeth move up along the inclined portions of the unidirectional inclined planes such that the inclined teeth jump up and down along the unidirectional inclined plane clockwise; but when the actuating member is rotated counterclockwise relative to the base, the vertical portions of the inclined teeth resist against the vertical portions of the unidirectional inclined planes such that the actuating member cannot be directly rotated counterclockwise relative to the base; and the knob covering the actuating member and being rotatable relative to the base, at least one assembling rib deposited on an inner surface of the knob, the assembling rib corresponding to the assembling space of the actuating member for driving the actuating member to rotate, a preserving space being defined between the assembling rib and the assembling space, wherein the assembling rib cannot touch the driving rib in the preserving space when the knob is rotated counterclockwise slightly, thereby the actuating member is not rotated counterclockwise by the knob, a plurality of adjusting ribs deposited on the inner surface of the knob and corresponding to the flexible arms, each of the adjusting ribs having a first inclined surface facing to the flexible arm, wherein each of the flexible arms is lifted up along the first inclined surface by the adjusting rib when the knob is kept rotating counterclockwise and the assembling rib keeps moving toward the driving rib in the preserving space, thereby each of the inclined teeth is disengaged with the unidirectional inclined planes;

wherein when the knob is rotated clockwise to drive the actuating member, the inclined teeth move up along the inclined portions of the unidirectional inclined planes such that the inclined teeth jump up and down along the unidirectional inclined plane clockwise and the actuating member is rotated clockwise relative to the base, consequently the gear wheel is rotated clockwise for tightening the flexible strap or the lace; when the knob stops rotating clockwise, the actuating member is stopped rotating because the vertical portions of the inclined teeth resist against the vertical portions of the unidirectional inclined planes, consequently the flexible strap or the lace is neither tightened nor loosed; when the knob is rotated counterclockwise to drive the actuating member, each of the flexible arms is lifted up along the first inclined surface by the adjusting rib and the assembling rib keeps moving toward the driving rib in the preserving space simultaneously; after each of the inclined teeth is disengaged with the unidirectional inclined planes completely, the actuating member can be rotated counterclockwise relative to the base, consequently the gear wheel is rotated counterclockwise for loosing the flexible strap or the lace; the knob never moves up and down along the axis during the operation for tightening or loosing the flexible strap or the lace.

2. The adjusting device for tightening or loosing laces and straps as claimed in claim 1, wherein the gear wheel has a connecting hole at the center and an opening is opened on the actuating member opposite to the connecting hole; the opening is communicating with the connecting hole thereby the axis of the base passes through the connecting hole and the opening for firmly connecting to the center of the knob.

3. The adjusting device for tightening or loosing laces and straps as claimed in claim 2, wherein the flexible strap further comprises a first strap and a second strap, the first strap having a lower teeth portion, the second strap having an upper teeth portion, the gear wheel engaging with the upper teeth portion and the lower teeth portion.

4. The adjusting device for tightening or loosing laces and straps as claimed in claim 1, wherein the flexible strap further comprises a first strap and a second strap, the first strap having a lower teeth portion, the second strap having an upper teeth portion, the gear wheel engaging with the upper teeth portion and the lower teeth portion.

5. The adjusting device for tightening or loosing laces and straps as claimed in claim 1, wherein each of the flexible arms has a second inclined surface; the first inclined surface facing to the second inclined surface is adapted to lift up the flexible arms smoothly along the adjusting ribs.

6. The adjusting device for tightening or loosing laces and straps as claimed in claim 1, wherein the knob has an anti-slipping texture formed on the lateral side of the knob.

7. The adjusting device for tightening or loosing laces and straps as claimed in claim 1, wherein a reel is placed into the base for connecting to the gear wheel of the actuating member, the reel having a lace groove for winding or unwinding the lace, an engaging hole opened at the center of the reel for engaging with the gear wheel of the actuating member.

* * * * *